US010792204B2

(12) United States Patent
Nomura et al.

(10) Patent No.: US 10,792,204 B2
(45) Date of Patent: Oct. 6, 2020

(54) ASSISTING DEVICE

(71) Applicant: FUJI CORPORATION, Chiryu (JP)

(72) Inventors: Hideaki Nomura, Toyota (JP); Joji Isozumi, Cupertino, CA (US); Nobuyuki Nakane, Toyota (JP); Kuniyasu Nakane, Okazaki (JP)

(73) Assignee: FUJI CORPORATION, Chiryu (JP)

( * ) Notice: Subject to any disclaimer, the term of this patent is extended or adjusted under 35 U.S.C. 154(b) by 70 days.

(21) Appl. No.: 16/097,953

(22) PCT Filed: May 17, 2016

(86) PCT No.: PCT/JP2016/064649
§ 371 (c)(1),
(2) Date: Oct. 31, 2018

(87) PCT Pub. No.: WO2017/199348
PCT Pub. Date: Nov. 23, 2017

(65) Prior Publication Data

US 2019/0142670 A1 May 16, 2019

(51) Int. Cl.
*A61G 7/10* (2006.01)
*A61G 5/14* (2006.01)

(52) U.S. Cl.
CPC ..... *A61G 7/1017* (2013.01); *A61G 5/14* (2013.01); *A61G 7/1019* (2013.01);
(Continued)

(58) Field of Classification Search
CPC .. A61G 7/1017; A61G 7/1019; A61G 7/1046; A61G 5/14; A61G 2200/34; A61G 2200/36
(Continued)

(56) References Cited

U.S. PATENT DOCUMENTS 4,435,863 A * 3/1984 Lerich ..... A61G 7/1017 280/304.1
4,810,018 A 3/1989 Van De Ven et al.
(Continued)

FOREIGN PATENT DOCUMENTS

DE 10 2011 009 899 A1 8/2012
EP 0 282 140 A2 9/1988
(Continued)

OTHER PUBLICATIONS

Office Action dated Jul. 15, 2019 in Singaporean Patent Application No. 11201809935V, 7 pages.
(Continued)

*Primary Examiner* — Robert G Santos
(74) *Attorney, Agent, or Firm* — Oblon, McClelland, Maier & Neustadt, L.L.P.

(57) ABSTRACT

An assisting device provide with: a movable base on which a care receiver rides; a raising and lowering member supported on the base to be movable in an up-down direction; a raising and lowering drive section configured to drive the raising and lowering member up and down; an oscillating member supported on the raising and lowering member to be capable of oscillating; an oscillating drive section configured to drive the oscillating of the oscillating member; a holding member supported on the oscillating member to be freely tiltable, and configured to hold an upper body of the care receiver; a first handle provided on the oscillating member; and a second handle provided on the holding member, and configured to tilt together with the holding member. Accordingly, practicality is improved with regard to safe moving operation of the assisting device and safe free tilting of the holding member.

5 Claims, 4 Drawing Sheets

(52) U.S. Cl.
CPC ..... *A61G 7/1046* (2013.01); *A61G 2200/34* (2013.01); *A61G 2200/36* (2013.01); *A61G 2200/52* (2013.01)

(58) Field of Classification Search
USPC ..... 5/86.1, 83.1, 87.1, 81.1 R
See application file for complete search history.

(56) References Cited

U.S. PATENT DOCUMENTS

| | | | | |
|---|---|---|---|---|
| 5,001,789 | A * | 3/1991 | Schoenberger | A61G 7/1017 5/87.1 |
| 7,392,554 | B1 * | 7/2008 | Su | A61G 7/1017 5/86.1 |
| 9,009,886 | B2 * | 4/2015 | Hjort | A61G 7/1019 5/83.1 |
| 9,038,212 | B2 * | 5/2015 | Yamaguchi | A61G 7/1017 5/87.1 |
| 9,254,232 | B2 * | 2/2016 | Hjort | A61G 7/1007 |
| 9,295,597 | B2 * | 3/2016 | Hjort | A61G 5/14 |
| 2002/0083584 | A1 | 7/2002 | Isogai et al. | |
| 2005/0246890 | A1 | 11/2005 | Isogai et al. | |
| 2006/0207090 | A1 | 9/2006 | Kawada | |
| 2013/0263374 | A1 * | 10/2013 | Yamaguchi | A61G 7/1017 5/87.1 |
| 2014/0289958 | A1 * | 10/2014 | Hjort | A61G 7/1007 5/83.1 |
| 2014/0289959 | A1 * | 10/2014 | Hjort | A61G 5/14 5/83.1 |
| 2014/0289960 | A1 | 10/2014 | Hjort et al. | |
| 2015/0359694 | A1 | 12/2015 | Suzuki et al. | |
| 2019/0142670 | A1 * | 5/2019 | Nomura | A61G 5/10 5/86.1 |
| 2019/0183706 | A1 * | 6/2019 | Shimizu | A61G 7/1046 |
| 2019/0201260 | A1 * | 7/2019 | Isozumi | A61G 5/14 |
| 2019/0238075 | A1 * | 8/2019 | Shimizu | A61G 5/14 |
| 2019/0350784 | A1 * | 11/2019 | Shimizu | A61G 7/1086 |

FOREIGN PATENT DOCUMENTS

| | | | | |
|---|---|---|---|---|
| EP | 2 954 882 | A1 | 12/2015 | |
| EP | 3 360 525 | A1 | 8/2018 | |
| EP | 3593779 | A1 * | 1/2020 | |
| JP | 2002-153521 | A | 5/2002 | |
| JP | 2008-36392 | A | 2/2008 | |
| JP | 2014-61448 | A | 4/2014 | |
| JP | 2015-47332 | A | 3/2015 | |
| WO | WO 92/04003 | A1 | 3/1992 | |
| WO | WO-2018131131 | A1 * | 7/2018 | A61G 7/1007 |
| WO | WO-2018163307 | A1 * | 9/2018 | A61G 7/1017 |
| WO | WO-2018179430 | A1 * | 10/2018 | A61G 7/1046 |
| WO | WO-2019026144 | A1 * | 2/2019 | A61G 5/14 |
| WO | WO-2019111356 | A1 * | 6/2019 | A61G 5/14 |
| WO | WO-2019111514 | A1 * | 6/2019 | A61G 5/14 |

OTHER PUBLICATIONS

Extended European Search Report dated Apr. 23, 2019 in Patent Application No. 15905336.2, 8 pages.

Corrected written opinion dated Jan. 15, 2020 in European Patent Application No. 16902367.8, 4 pages.

Australian Office Action dated May 6, 2019 in Australian Patent Application No. 2016406917, 4 pages.

International Search Report dated Jun. 28, 2016 in PCT/JP2016/064649 filed on May 17, 2016.

* cited by examiner

ASSISTING DEVICE

TECHNICAL FIELD

The present application relates to an assisting device for assisting a care receiver to stand up and sit down.

BACKGROUND ART

As societies ages, the need for assisting devices is increasing. Assisting devices are for assisting a care receiver to perform actions such as transferring, moving, going to the toilet, and the like, and may be equipped with a function for assisting with standing up or sitting down. Using an assisting device can reduce the physical load on a caregiver, thereby preventing back pain or the like, as well as mitigating shortages of caregiving staff. An example of technology related to this type of assisting device is disclosed in patent literature 1.

An assisting device of patent literature 1 is provided with a pair of left and right arm sections that are inserted under the arms of a care receiver, with the care receiver being assisted to stand up by the arm sections being raised. This assisting device is characterized by having arm sections with end portions that freely bend inward so as to support the back of the care receiver. The assisting device also includes a chest support (holding member) that contacts the chest of the care receiver, a grip gripped by the care receiver, a handle used by the caregiver when moving, and the like. As a result, it is possible to give the care receiver the same sense of security as when being held by someone when being assisted to stand up.

CITATION LIST

Patent Literature

Patent Literature 1: JP-A-2008-36392

BRIEF SUMMARY

Technical Problem

However, with an assisting device of patent literature 1, to improve the usability for the care receiver, the configuration allows tilting in an up-down direction and in a left-right direction of the chest pad. With this configuration, because a care receiver can adjust their posture as needed, standing up and sitting down can be performed naturally without discomfort. However, with an assisting device that allows tilting of the chest pad such as this, there is room for improving the layout of items such as the grip and the handle with respect to the chest pad.

The present disclosure takes account of such circumstances, and an object thereof is to provide an assisting device with a freely tiltable holding member that holds a care receiver, the assisting device achieving high practicality due to an arrangement of a handle.

Solution to Problem

An assisting device of the present disclosure includes: a movable base on which a care receiver rides; a raising and lowering member supported on the base to be movable in an up-down direction; a raising and lowering drive section configured to drive the raising and lowering member up and down; an oscillating member supported on the raising and lowering member to be capable of oscillating; an oscillating drive section configured to drive the oscillating of the oscillating member; a holding member supported on the oscillating member to be freely tiltable, and configured to hold an upper body of the care receiver; a first handle provided on the oscillating member; and a second handle provided on the holding member, and configured to tilt together with the holding member.

Advantageous Effects

With an assisting device of the present disclosure, because the holding member and the first handle are separate items, the first handle is not freely tiltable even though the holding member is freely tiltable. Thus, when a caregiver uses the first handle to move the assisting device, moving operation can be performed stably. Also, because the second handle and the holding member are integrated to tilt together, the relative position of the holding member and the second handle does not change. Therefore, a care receiver can freely tilt the holding member safely. In this manner, an assisting device of the present disclosure has improved practicality due to an arrangement of a first handle and a second handle.

DESCRIPTION OF EMBODIMENTS

1. Configuration of Assisting Device 1 of an Embodiment

Figure 1:
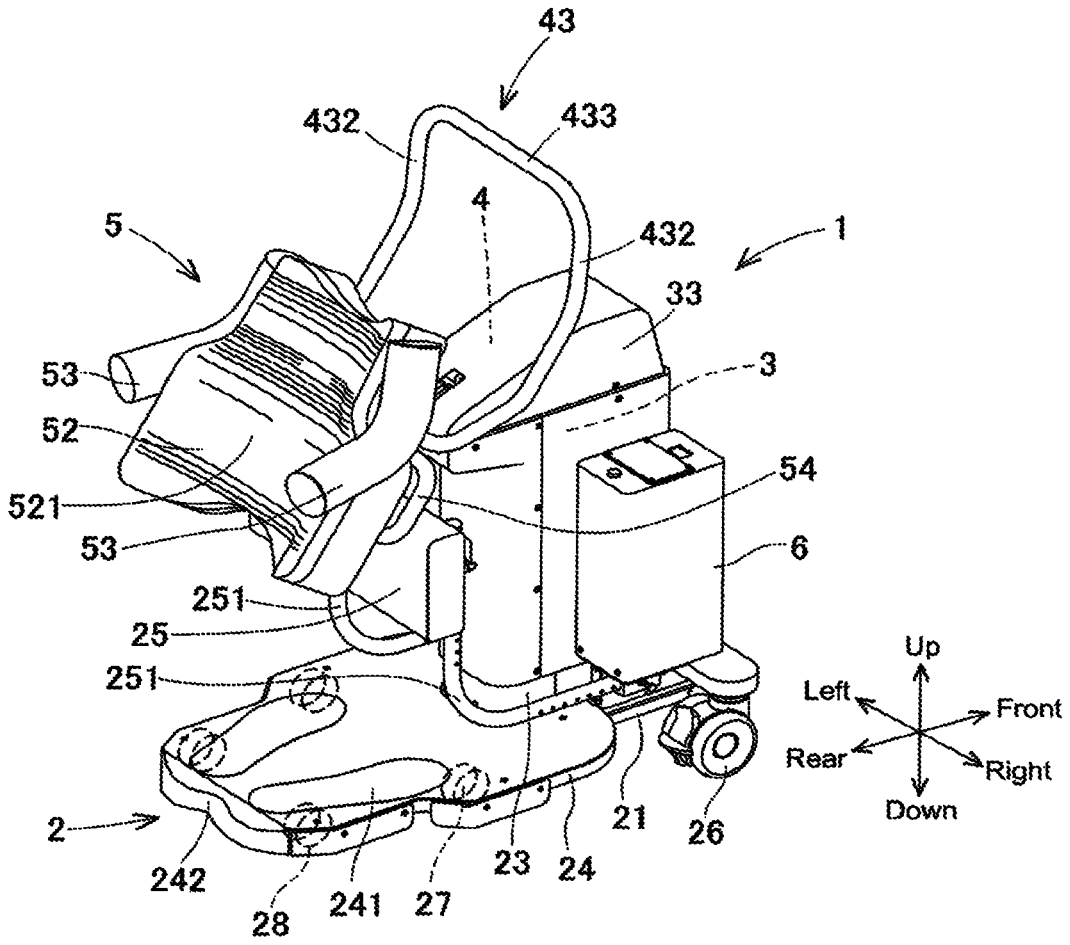
FIG. 1 is a perspective view diagonally from the rear of an assisting device of an embodiment of the disclosure.
Figure 2:
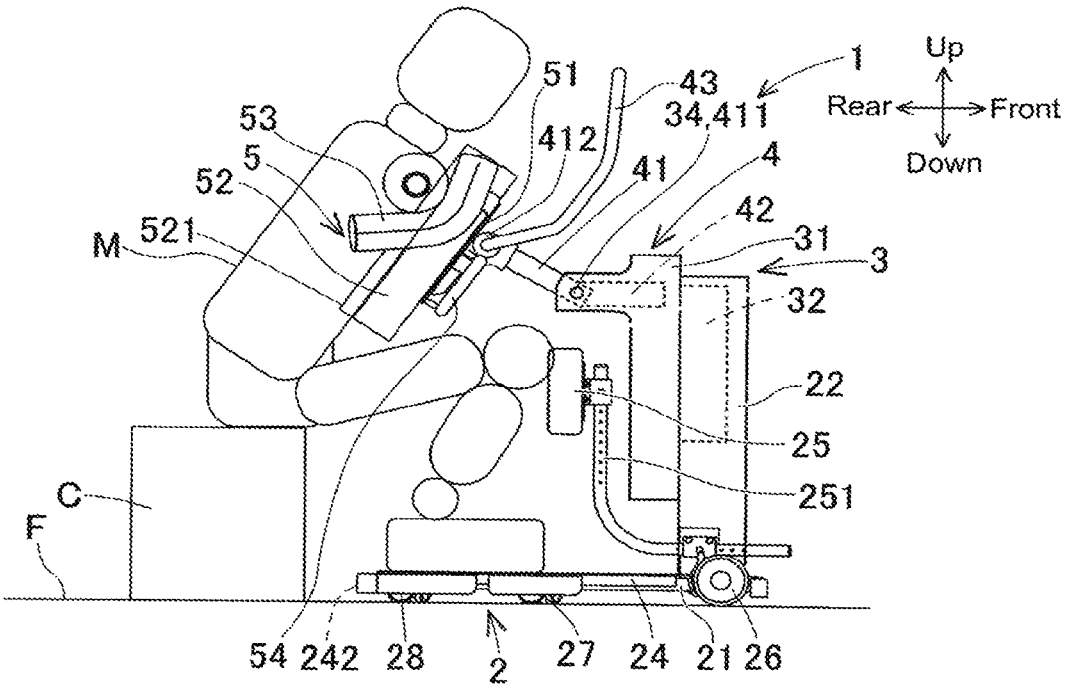
FIG. 2 is a side view showing the configuration of the assisting device and a care receiver in a sitting posture.
Figure 3:
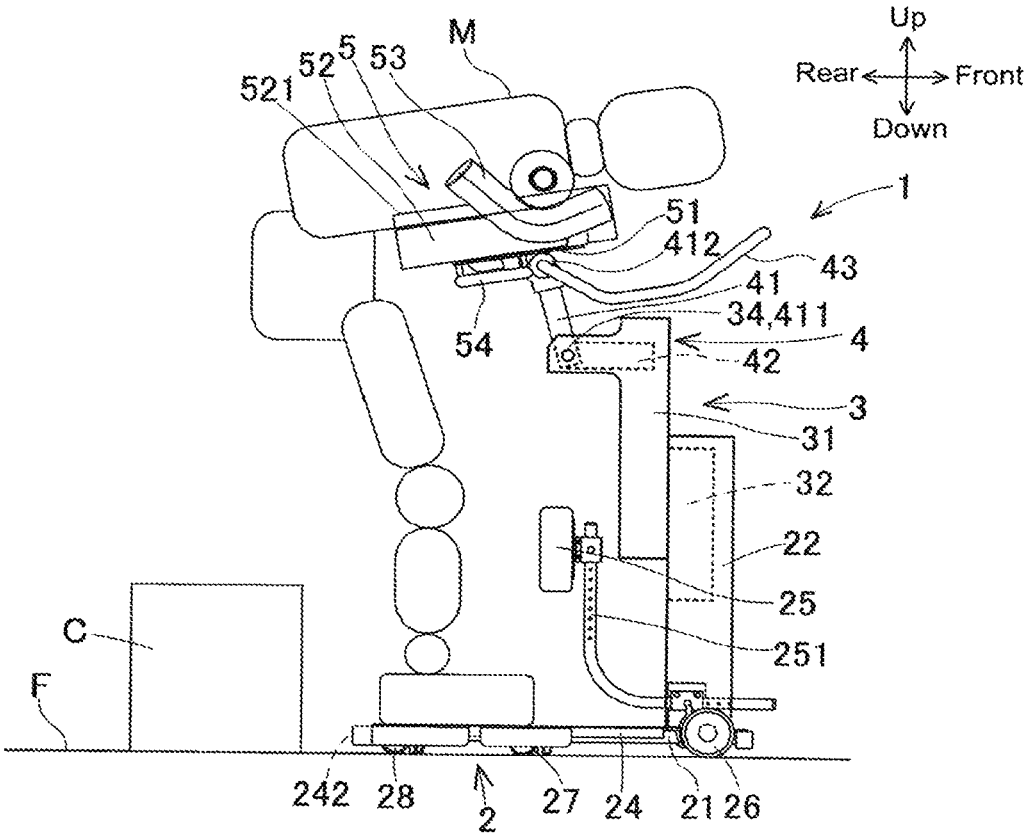
FIG. 3 is a side view showing the configuration of the assisting device and a care receiver in a standing posture.

Assisting device 1 of an embodiment of the present disclosure will be described with reference to FIGS. 1 to 6. FIG. 1 is a perspective view diagonally from the rear of assisting device 1, which is an embodiment of the disclosure. Also, FIG. 2 is a side view showing the configuration of assisting device 1 and care receiver M in a sitting posture; FIG. 3 is a side view showing the configuration of assisting device 1 and care receiver M in a standing posture. The front-rear direction, left-right direction, and up-down direction as shown in FIG. 1 are defined based on care receiver M shown in FIGS. 2 and 3. Note that, fixed cover 23, raising and lowering cover 33, and control section 6 are omitted from FIGS. 2 and 3.

Assisting device 1 performs standing assistance of assisting care receiver M from a sitting posture to a standing posture, and sitting assistance of assisting care receiver M from a standing posture to a sitting posture. Further, a caregiver can operate assisting device 1 to move with care receiver M riding in a standing posture. Thus, assisting device 1 can assist care receiver M in transferring and moving. Note that, in the present disclosure, a "standing posture" refers to a state in which the lower half of care receiver M is upright, regardless of the posture of the upper half of care receiver M. Assisting device 1 is configured from items such as base 2, raising and lowering section 3, oscillating section 4, holding member 5, and control section 6.

Base 2 is configured from items such as frame 21, support column 22, fixed cover 23, footrest 24, lower limb contacting section 25, and six wheels 26 to 28. Frame 21 is provided near floor surface F in a substantially horizontal manner. Support column 22 is provided upright on frame 21 towards the front and in the center in the left-right direction. Raising and lowering device section 32, described later, is provided inside support column 22 with a substantially rectangular cross section. Fixed cover 23 covers and protects support column 22 and around a lower section of raising and lowering member 31, which is described later.

Footrest 24 is fixed towards the rear of an upper surface of frame 21 in a substantially horizontal manner. Foot-shaped contact marks 241 on an upper surface of footrest 24 act as a guide for where care receiver M should place their feet. Base 2 has sufficient mechanical strength for care receiver M to ride on it. Recess 242 is formed at the center of a rear section of footrest 24. Lower limb contacting section 25 is arranged above and slightly to the front of contact marks 241 by a pair of left and right support arms 251. The pair of left and right support arms 251 each extend to the rear from the sides of support column 22 on the upper surface of frame 21, are curved in the middle, and then extend up. Lower limb contacting section 25 is arranged straddling the upright portions of the left and right support arms 251 extending in the left-right direction. Lower limb contacting section 25 is a portion for the lower limbs of care receiver M to contact and is made of a cushion material. The arrangement height of lower limb contacting section 25 can be adjusted.

A pair of left and right front wheels 26 are provided towards the front of frame 21. Front wheels 26 have a steering function for changing the movement direction and a locking function for restricting movement. A pair of left and right center wheels 27 are provided on the underside of footrest 24 at an intermediate position in the front-rear direction. Further, a pair of left and right rear wheels 28 are provided on the underside of footrest 24 towards the rear. Center wheels 27 and rear wheels 28 have a steering function for changing the movement direction. Frame 21 and footrest 24 are supported horizontally slight above floor surface F by the six wheels 26 to 28. Due to the steering function of the six wheels 26 to 28, assisting device 1 is not only capable of moving in a front-rear direction and changing directions but is capable of moving laterally (moving directly to the side) and spinning (rotating on the spot).

Raising and lowering section 3 is configured from items such as raising and lowering member 31, raising and lowering drive section 32, and raising and lowering cover 33. Raising and lowering member 31 is elongated in the up-down direction and supported on the rear surface of support column 22 to be movable up and down. An upper section of raising and lowering member 31 protrudes to the rear and oscillating support section 34 is provided towards the end that protrudes to the rear. Oscillating drive section 42 is provided inside an upper portion of raising and lowering member 31. Raising and lowering drive section 32 arranged inside support column 22 drives the up-down movement of raising and lowering member 31. Raising and lowering cover 33 covers and protects raising and lowering member 31 and the upper part of support column 22. Raising and lowering cover 33 is attached to raising and lowering member 31 and moves up and down with raising and lowering member 31. A lower portion of raising and lowering cover 33 that moves up and down always overlaps an outside portion of fixed cover 23.

Oscillating section 4 is configured from items such as oscillating arm member 41 and oscillating drive section 42, and first handle 43 is attached to oscillating section 4. Oscillating arm member 41 corresponds to "an oscillating member supported on the raising and lowering member to be capable of oscillating" of the present disclosure. End 411 of oscillating arm member 41 is supported by oscillating support section 34 of raising and lowering member 31 to be capable of oscillating. Oscillating drive section 42 provided inside an upper portion of raising and lowering member 31 oscillates end 412 of oscillating arm member 41 in the front-rear direction around end 411. The oscillating range of oscillating arm member 41 is restricted by a stopper member, which is not shown. Tilt support shaft 44 (refer to FIG. 5) is provided on end 412 of oscillating arm member 41. First handle 43 is integrated with end 412 of oscillating arm member 41 (details are described later).

Holding member 5 is configured from items such as support member 51, torso receiving section 52, and left and right pair of underarm sections 53, and second handle 54 is attached to holding member 5. The front underside of support member 51 is supported by tilt support shaft 44 of oscillating arm member 41 to be freely tiltable (details are described later). Torso receiving section 52 is provided on a rear upper side of support member 51. Torso receiving section 52 is formed from a cushion material that easily changes shape and has a surface that closely matches the shape of the torso of care receiver M. The surface of torso receiving section 52 that contacts care receiver M from their chest to their abdomen is support surface 521. Support surface 521 supports the torso of care receiver M from below.

The pair of left and right underarm sections 53 are provided on the left and right of torso receiving section 52. Underarm sections 53 are formed in an arc shape facing upward and support both underarms of care receiver M from below. Thus, torso receiving sections 52 and underarm sections 53 hold the upper body of care receiver M in a stable manner. Second handle 54 is integrated with support member 51 by being attached to a front lower side thereof (details are described later).

Control section 6 is provided on a top right side of frame 21. Control section 6 controls raising and lowering drive section 32 and oscillating drive section 42 based on instructions from care receiver M or a caregiver. A computer running software may be used as control device 6. The computer may be provided with a remote control, not shown, for receiving instructions from care receiver M or the caregiver. A standing-assistance program for assisting in standing and a sitting-assistance program for assisting in sitting may be stored as executable software. A rechargeable battery pack, reference numeral omitted, is attached to the lower side of control section 6. The battery pack is also attached to the top left side of frame 21. The battery pack is also shared with raising and lowering drive section 32 and oscillating drive section 42.

2. Shape and Attachment Configuration of First Handle 43 and Second Handle 54

Figure 4:
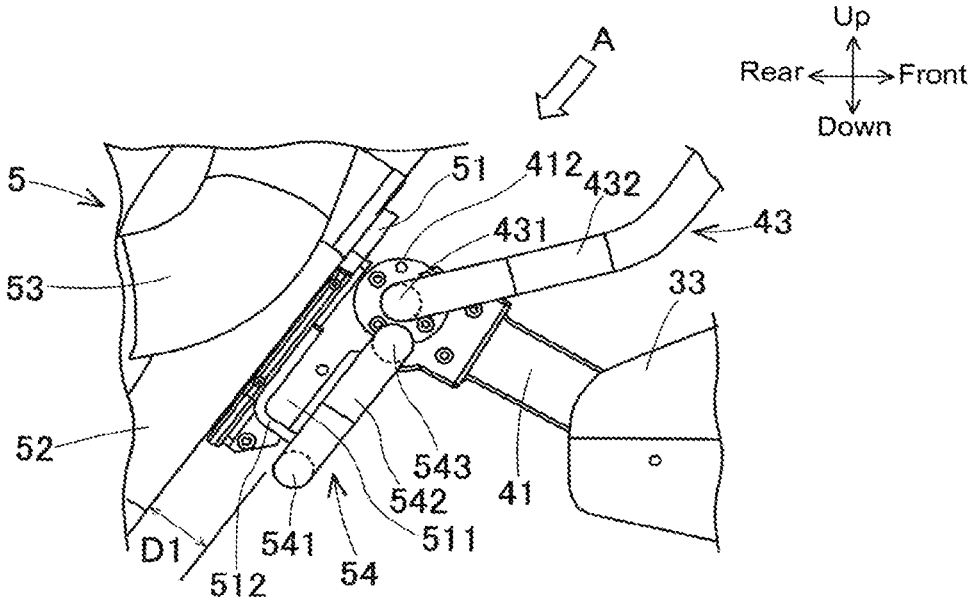
FIG. 4 is a partial side view showing the shapes and attachment configurations of a first handle and a second handle.
Figure 5:
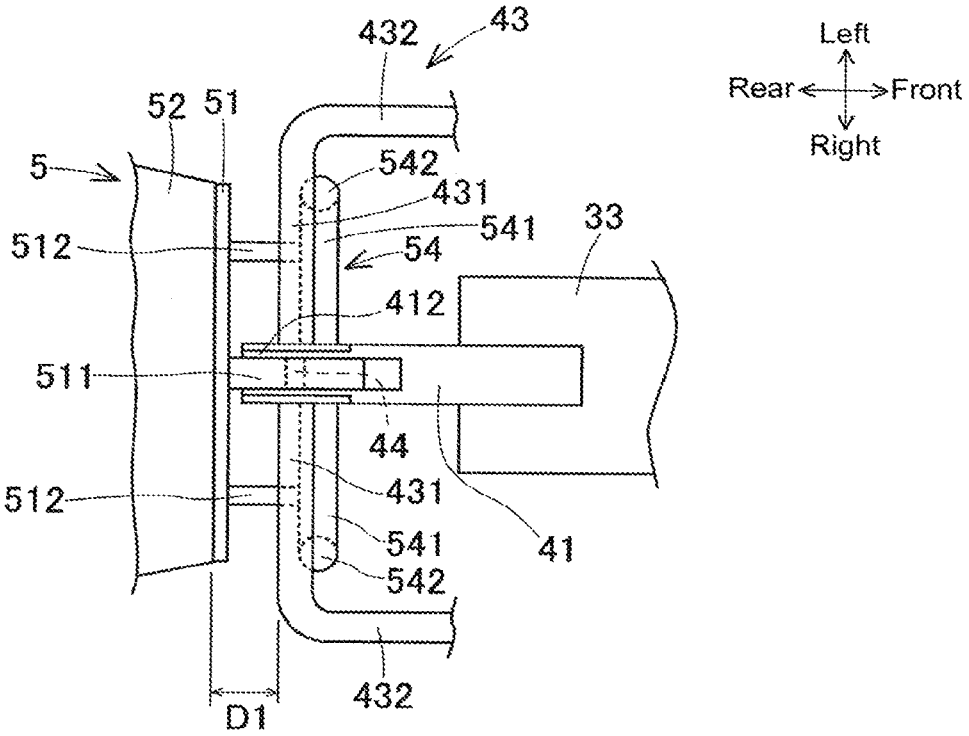
FIG. 5 is a view from the direction of arrow A in FIG. 4 of the shapes and attachment configurations of the first handle and the second handle.

Next, first handle 43 and second handle 54 will be described in detail. FIG. 4 is a partial side view showing the shapes and attachment configurations of first handle 43 and second handle 54. FIG. 5 is a view from the direction of arrow A in FIG. 4 of the shapes and attachment configurations of first handle 43 and second handle 54.

First handle 43 is a roughly rectangular frame. First handle 43 is configured from a pair of left and right first handle base shafts 431, a pair of left and right first handle sections 432, and moving handle section 433 (refer to FIG. 1). As shown in FIG. 5, left and right first handle base shafts 431 are fixed to the ends of bifurcated end 412 of oscillating arm member 41 extending in the left and right directions. Left and right first handle sections 432 are connected to the ends of first handle base shafts 431, are bent 90 degrees, and extend forward and up. The left and right first handle sections 432 are parallel to each other and curve rearwards and up. Moving handle section 433 connects the respective ends of the pair of left and right first handle sections 432 and extends in the left-right direction.

Tilt support shaft 44 is provided between the two prongs of end 412 of oscillating arm member 41. Tilt support shaft 44 is positioned between the pair of left and right first handle base shafts 431. Support member 51 of holding member 5 includes tilting member 511 that engages on the outside of tilt support axis 44. Thus, holding member 5 is freely tiltable around oscillating support shaft 44 as an axis line, that is, is freely tiltable around first handle base shaft 431 as an axis line. The tilting range of holding member 5 is restricted by a stopper, which is not shown, to within a range shown in FIGS. 4 to 6 (described later).

Second handle 54 is configured from second handle base shaft 541, pair of left and right second handle sections 542, and pair of left and right second handle ends 543. As shown in FIGS. 4 and 5, second handle base shaft 541 is fixed to a pair of handle attachment mounts 512 extending from support member 51. Second handle base shaft 541 passes the underside of holding member 5 opposite to the holding surface 521 side and extends in the left and right directions. The pair of left and right second handle sections 542 are connected to the left and right ends of second handle base shaft 541, are bent 90 degrees, and extend parallel to each other forward and up.

The pair of left and right second handle ends 543 are connected to the ends of second handle section 542, are bent 90 degrees, and extend part of the way to end 412 of oscillating arm member 41. Fixed separation distance D1 is maintained between second handle 54 and torso receiving section 52. Separation distance D1 is set appropriately considering safety such that no body parts of care receiver M will be sandwiched.

Care receiver M grips first handle sections 432 of first handle 43 when standing up and sitting down. A caregiver can move assisting device 1 by gripping and pulling moving handle sections 433 of first handle 43. Further, a caregiver can grip one of the moving handle sections 433 or one of the first handle sections 432 of first handle 43 with one hand, and second handle section 542 of second handle 54 with the other hand to rotate or move assisting device 1 sideways.

3. Usage Method and Operation of Assisting Device 1 of the Embodiment

Next the use and operation of assisting device 1 of the embodiment will be described. Descriptions are given using an example of care receiver M sitting on seat C performing a standing operation. If assisting device 1 is far away, a caregiver moves assisting device 1 in advance close to care receiver M. First care receiver M in a sitting posture pulls assisting device 1 towards themself. By doing so, as shown in FIG. 2, both legs of care receiver M are positioned under holding member 5. Here, if holding member 5 is in the way, care receiver M raises the lower end of holding member 5 with their hands, or raises the lower end of holding member 5 and second handle base shaft 541 of second handle 54 with their knees. Thus, holding member 5 is tilted forward. Care receiver M then puts their feet on contact marks 241. The lower limbs of care receiver M contact or come close to lower limb contacting section 25.

Next, care receiver M starts an initial operation routine of a standing-assistance program of control section 6. By this, the height of raising and lowering member 31 is adjusted to match the physique of care receiver M. Then, care receiver M puts their upper body against torso receiving section 52 and puts their arms onto underarm sections 53. Further, care receiver M grips the left and right first handle sections 432 of first handle 43 with each hand. Thus, care receiver M is in the sitting posture shown in FIG. 2. In the sitting posture, the upper body of care receiver M is leaning slightly forward. Here, holding member 5 is in a sitting posture.

Continuing, care receiver M starts a standing-assistance routine of the standing-assistance program. By this, up-down movement of raising and lowering member 31 and forward oscillation of oscillating arm member 41 are performed in a coordinated manner. By the time the standing-assistance program has finished, raising and lowering member 31 has been raised and oscillating arm member 41 has been oscillated forward such that care receiver M is in the standing posture shown in FIG. 3. In the standing posture, the upper body of care receiver M is leaning forward to a large degree. Here, holding member 5 is in a transferring posture. First handle 43 is arranged at the front of holding member 5 in the transferring posture, and second handle 54 is arranged below holding member 5 in the transferring posture.

Because a sitting operation of care receiver M is largely the reverse of a standing operation, descriptions are omitted. Note that, a portion of the series of standing operation performed by care receiver M as described above may be performed with the assistance of a caregiver, or entirely by a caregiver instead of care receiver M.

The caregiver can move care receiver M in the standing posture shown in FIG. 3 together with assisting device 1 and transfer care receiver M to a place other than the seat C. Here, first handle 43 is not freely tiltable even though holding member 5 is freely tiltable when care receiver M changes posture. Thus, when a caregiver uses first handle 43 to move assisting device 1, moving operation can be performed stably. Also, as understood by comparing FIGS. 2 and 3, support surface 521 of torso receiving section 52 in the transferring posture is closer to being horizontal than support surface 521 in the sitting posture. Thus, care receiver M is able to move in a comfortable posture with their body weight on holding member 5.

Figure 6:
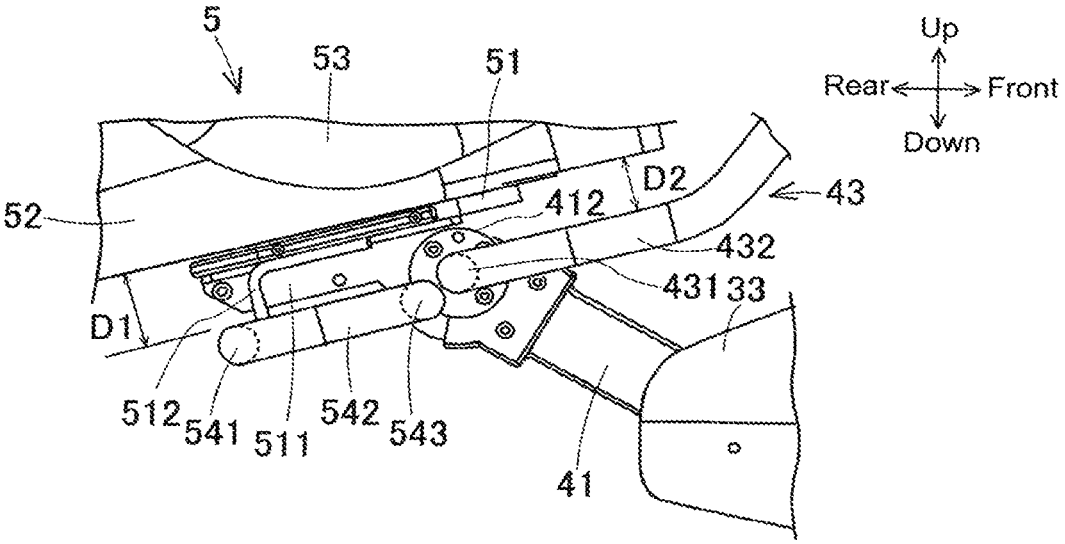
FIG. 6 is a partial side view showing an example of a state with a holding member tilted forward.

At any time during a standing operation or a moving operation of care receiver M, free tilting of holding member 5 with respect to oscillating arm member 41 is possible. FIG. 6 is a partial side view showing an example of a state with holding member 5 tilted forward. The state in FIG. 6 occurs, for example, when care receiver M raises the lower end of holding member 5 when pulling assisting device 1 towards themself.

As shown in FIG. 6, as holding member 5 is tilted forward, it approaches first handle 43. However, separation distance D2 is maintained between torso receiving section 52 and first handle 43. Separation distance D2 is is set appropriately considering safety such that no body parts of care receiver M will be sandwiched. Further, because first handle section 432 of first handle 43 is arranged separated further to the left and right than torso receiving section 52, first handle section 432 does not approach torso receiving section 52. Thus, safety is maintained because no body parts of a care receiver will be sandwiched between holding member 5 and first handle 43.

Also, second handle 54 is integrated with holding member 5 such that they tilt together. Therefore, separation distance D1 is always maintained without the relative positions of holding member 5 and second handle 54 changing. Thus, safety is maintained because no body parts of a care receiver will be sandwiched between holding member 5 and second handle 54. Further, holding member 5 and second handle 54 are freely tiltable around first handle base shaft of first handle 43 as an axis line. Thus, a fixed separation distance is maintained between second handle 54 and first handle base shaft 431, thereby maintaining safety.

4. Modes and Effects of Assisting Device 1 of Embodiments

Assisting device 1 of an embodiment is provided with: movable base 2 on which care receiver M rides; raising and lowering member 31 supported on base 2 to be movable in an up-down direction; raising and lowering drive section 32 configured to drive raising and lowering member 31 up and down; oscillating arm member 41 supported on raising and lowering member 31 to be capable of oscillating; oscillating drive section 42 configured to drive the oscillating of oscillating arm member 41; holding member 5 supported on oscillating arm member 41 to be freely tiltable, and configured to hold an upper body of care receiver M; first handle 43 provided on oscillating arm member 41; and second handle 54 provided on holding member 6, and configured to tilt together with holding member 5.

With assisting device 1 of the embodiment, because holding member 5 and first handle 43 are separate items, first handle 43 is not freely tiltable even though holding member 5 is freely tiltable. Thus, when a caregiver uses first handle 43 to move assisting device 1, moving operation can be performed stably. Also, because second handle 54 and holding member 5 are integrated to tilt together, the relative position of holding member 5 and second handle 54 does not change. Therefore, care receiver M can freely tilt holding member 5 safely. In this manner, assisting device 1 of the embodiment has improved practicality due to an arrangement of first handle 43 and second handle 54.

Further, second handle 54 includes second handle base shaft 541 that extends in a left-right direction of care receiver M held by holding member 5, second handle base shaft 541 passing by an underside of holding member 5 that does not contact care receiver M, and second handle section 542 provided at both ends of second handle base shaft 541. Accordingly, because second handle base shaft 541 can be lifted by the knees of care receiver M, holding member 5 can be freely tilted easily. Also, because second handle section 542 can be gripped by a caregiver, assisting device 1 can be moved easily.

Further, first handle 43 includes first handle base shaft 431 that extends in a left-right direction of care receiver M held by holding member 5, first handle base shaft 431 being fixed to oscillating arm member 41, and first handle section 432 provided at both ends of second handle base shaft 431, with holding member 5 being freely tiltable around first handle base shaft 431 as an axis line. Accordingly, because a fixed separation distance is maintained between second handle 54 and first handle base shaft 431, safety is maintained.

Further, first handle 43 can be gripped by care receiver M and a caregiver, and second handle 54 can be gripped by a caregiver. Accordingly, a caregiver can operation the assisting device at two locations, gripping first handle 43 with one hand and second handle 54 with another hand. Thus, assisting device 1 is easy to move. Also, because first handle 43 is used by both care receiver M and the caregiver, the number of components configuring assisting device 1 is reduced.

Further, holding member 5 is changed to a transferring posture by being oscillated forward from a sitting posture, first handle 43 is arranged at a front side of holding member 5 in the transferring posture, and second handle 54 is arranged at a lower side of holding member 5 in the transferring posture. Accordingly, a caregiver can grip second handle 54 from under the arms of care receiver M, with access being easy. Also, because a caregiver can grip first handle 43 and second handle 54 that are separated in a front-rear direction, usability for operations such as changing the direction of, moving sideways, and rotating assisting device 1 is extremely good and it is easy to control the position of assisting device 1.

5. Adaptations and Modifications of Embodiments

Note that, by omitting oscillating section 4 described in an embodiment above, holding member 5 can have an easy configuration that moves up and down and tilts. Also, the shapes of first handle 43 and second handle 54 can be changed as appropriate. Various other modifications and adaptations may be made to the present disclosure.

REFERENCE SIGNS LIST

1: assisting device; 2: base;
3: raising and lowering section; 31: raising and lowering member; 32: raising and lowering drive section;
4: oscillating section; 41: oscillating arm member; 42: oscillating drive section; 43: first handle; 431: first handle base shaft; 432: first handle section;
5: holding member; 54: second handle; 541: second handle base shaft; 542: second handle section

The invention claimed is:

1. An assisting device comprising:
a movable base on which a care receiver is configured to ride;
a raising and lowering member supported on the base to be movable in an up-down direction;
a raising and lowering drive configured to drive the raising and lowering member up and down;
an oscillating member supported on the raising and lowering member, the oscillating member configured to oscillate within an oscillating range;
an oscillating drive section configured to drive the oscillating of the oscillating member;
a holding member configured to hold an upper body of the care receiver, the holding member supported on the oscillating member to be freely tiltable with respect to the oscillating member;
a first handle provided on the oscillating member; and
a second handle provided on the holding member, the second handle configured to tilt together with the holding member.

2. The assisting device according to claim 1, wherein the second handle includes
a second handle base shaft configured to extend in a left-right direction of the care receiver held by the holding member, the second handle base shaft passing by an underside of the holding member that is not configured to contact the care receiver, and
a second handle section provided at both ends of the second handle base shaft.

3. The assisting device according to claim 1, wherein the first handle includes a first handle base shaft configured to extend in a left-right direction of the care receiver held by the holding member, the first handle base shaft being fixed to the oscillating member, and a first handle section provided at both ends of the first handle base shaft, wherein the holding member is freely tiltable around the first handle base shaft as an axis line.

4. The assisting device according to claim 1, wherein the first handle is configured to be gripped by the care receiver and a caregiver, and the second handle is configured to be gripped by the caregiver.

5. The assisting device according to claim 1, wherein the holding member is changed to a transferring posture by being oscillated forward from a sitting posture, the first handle is arranged at a front side of the holding member in the transferring posture, and the second handle is arranged at a lower side of the holding member in the transferring posture.

* * * * *